US008628224B1

(12) United States Patent
Speidel et al.

(10) Patent No.: US 8,628,224 B1
(45) Date of Patent: Jan. 14, 2014

(54) ARTICULATING ACCESSORY CARTRIDGE FOR LIGHTING FIXTURE

(75) Inventors: John Speidel, Highland Falls, NY (US); Vincent Gennarelli, Washingtonville, NY (US); Frank Reidmiller, Highland Lakes, NJ (US); Peter Eagleton, Yorktown Heights, NY (US); Jose Cadena, Mt. Kisco, NY (US); Scott Wisniewski, Highland Falls, NY (US)

(73) Assignee: Lighting Services, Inc., Stony Point, NY (US)

( * ) Notice: Subject to any disclaimer, the term of this patent is extended or adjusted under 35 U.S.C. 154(b) by 266 days.

(21) Appl. No.: 13/283,054

(22) Filed: Oct. 27, 2011

(51) Int. Cl.
*F21V 17/00* (2006.01)

(52) U.S. Cl.
USPC ..... 362/455; 362/277; 362/319; 362/449

(58) Field of Classification Search
USPC ..... 362/145, 147–150, 277, 307, 319, 362/433–457
See application file for complete search history.

(56) References Cited

U.S. PATENT DOCUMENTS 6,942,368 B1 9/2005 Kane et al.
7,988,336 B1 8/2011 Harbers et al.

*Primary Examiner* — Jason Moon Han
(74) *Attorney, Agent, or Firm* — St. Onge Steward Johnston & Reens LLC

(57) ABSTRACT

An articulating accessory cartridge for use in theatrical and commercial lighting fixtures in which optical accessories are utilized. The cartridge includes an outer member removably insertable in the fixture and an inner member telescopically retained in the outer member. One or several optical accessories can be removably received and retained in the inner member in an axial stack, depending upon effects desired. The inner cartridge member is telescopically extended before the cartridge is mounted on the fixture. As the cartridge is inserted, the uppermost accessory engages the end of a reflector associated with a light source in the fixture. Continued insertion of the cartridge results in telescopic retraction of the inner cartridge member, depending upon the number of accessories in the stack, until the outer cartridge member is fully seated. The accessories are held against the end of the reflector for optimal efficiency of the lighting and lighting effects.

16 Claims, 7 Drawing Sheets

ARTICULATING ACCESSORY CARTRIDGE FOR LIGHTING FIXTURE

FIELD OF THE INVENTION

The invention relates to the field of specialty lighting and more particularly to specialty lighting fixtures useful for theater and commercial lighting applications, where the fixtures frequently incorporate accessory elements such as distributing lenses, color discs and the like, and especially where there may be a need or desire to change the accessories from time to time.

BACKGROUND OF THE INVENTION

Specialized lighting fixtures, such as for theaters, museums, galleries, exhibits, etc. frequently employ accessory elements, such as color filters, conditioners, beam spreading or concentrating lenses, and the like to achieve desired lighting effects. In many such circumstances, it is necessary or desirable to change the accessories from time to time to accommodate changes in the lighting requirements. As set forth in a related U.S. Pat. No. 6,942,368, to Kenneth M. Kane et al, it is advantageous to utilize a removable cartridge to hold the desired accessories. This allows the accessories to be installed in a cartridge in the proper order, at a work bench or other convenient location, after which the cartridge can be quickly and easily inserted into the lighting fixture. This minimizes the time and effort required of a service man while working high on a ladder.

Inasmuch as a given lighting fixture may typically utilize from one to three accessories, and occasionally none, there was a need to be able to optimally position the accessories with respect to the light source, in order to enhance the efficiency of the lighting and the effectiveness of the accessories.

SUMMARY OF THE INVENTION

The present invention is directed to an improved form of accessory cartridge, which can be replaceably installed in a lighting fixture and which automatically results in a desired positioning of the accessories relative to the light source, regardless of the number of accessories installed in the cartridge. To this end, the accessory cartridge of the invention comprises two telescopically joined cartridge members. An outer member is of a size and shape to be received in a fixed position at the open end of the lighting fixture. An inner member is received within the outer member and is telescopically movable with respect thereto over a fixed range of axial movement. Detent arrangements are provided to retain the two members in any position with the intended axial range, unless intentionally displaced.

In the preferred and illustrated embodiment of the invention, the inner cartridge member is of a size and shape to receive one or more, usually but not necessarily up to a maximum of three, accessory elements. Typically, the accessory elements are flat discs which, if more than one is used, are arranged in an axial stack, one on top of the next. After the cartridge is loaded with the desired accessories, the inner and outer members are moved into an axially extended configuration in which the accessories are elevated in relation to the bottom of the cartridge.

When the loaded cartridge is partially inserted into the open end of the fixture, the uppermost accessory disc engages a fixed stop element within the fixture housing. Thereafter, as the outer cartridge member is moved deeper into the housing, the inner cartridge member is held by the stop element and retains a desired predetermined position relative to the light source while the outer cartridge member is being fully seated in the fixture. To advantage, the stop element is the open end of a reflector which surrounds the light source and directs its light in a desired manner from the fixture housing.

For a more complete understanding of the above and other features and advantages of the invention, reference should be made to the following detailed description of a preferred embodiment of the invention and to the accompanying drawings.

DETAILED DESCRIPTION OF THE INVENTION

Figure 1:
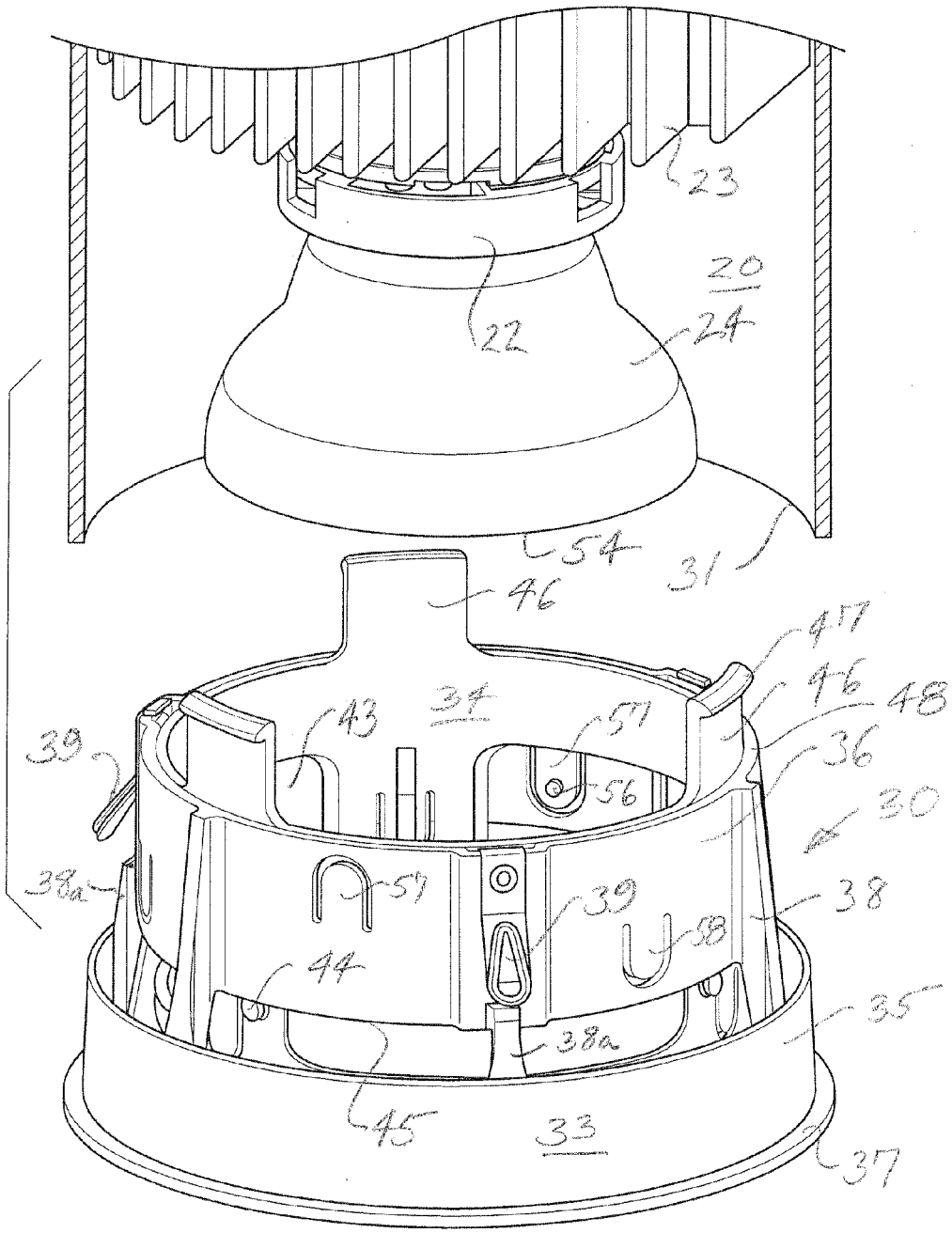
FIG. 1 is an exploded perspective view, partly in section of a lighting fixture and articulating accessory cartridge according to the invention.
Figure 2:
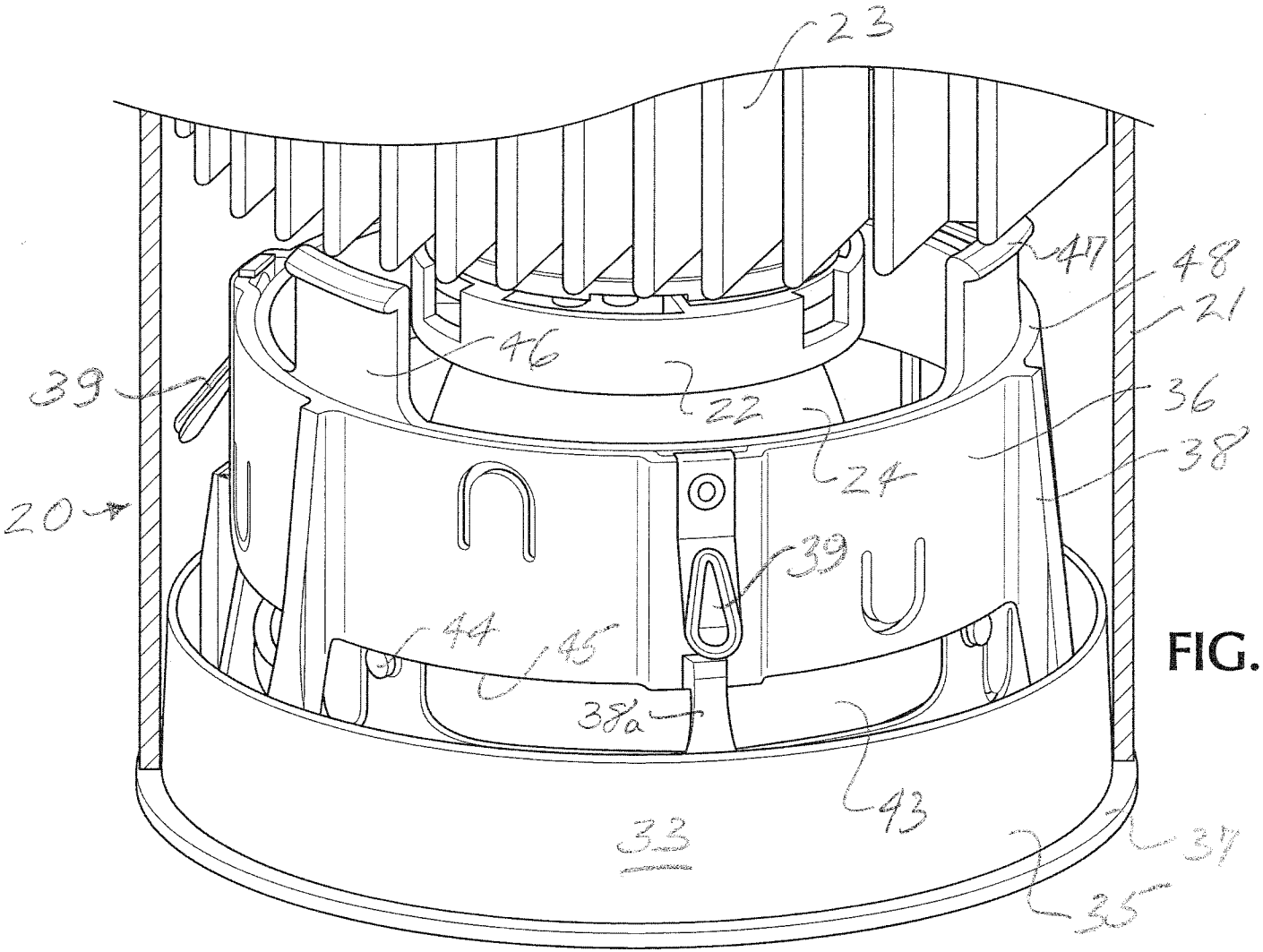
FIG. 2 is a perspective view, partly in section, showing the lighting fixture and accessory cartridge of FIG. 1 in assembled relation.
Figure 3:
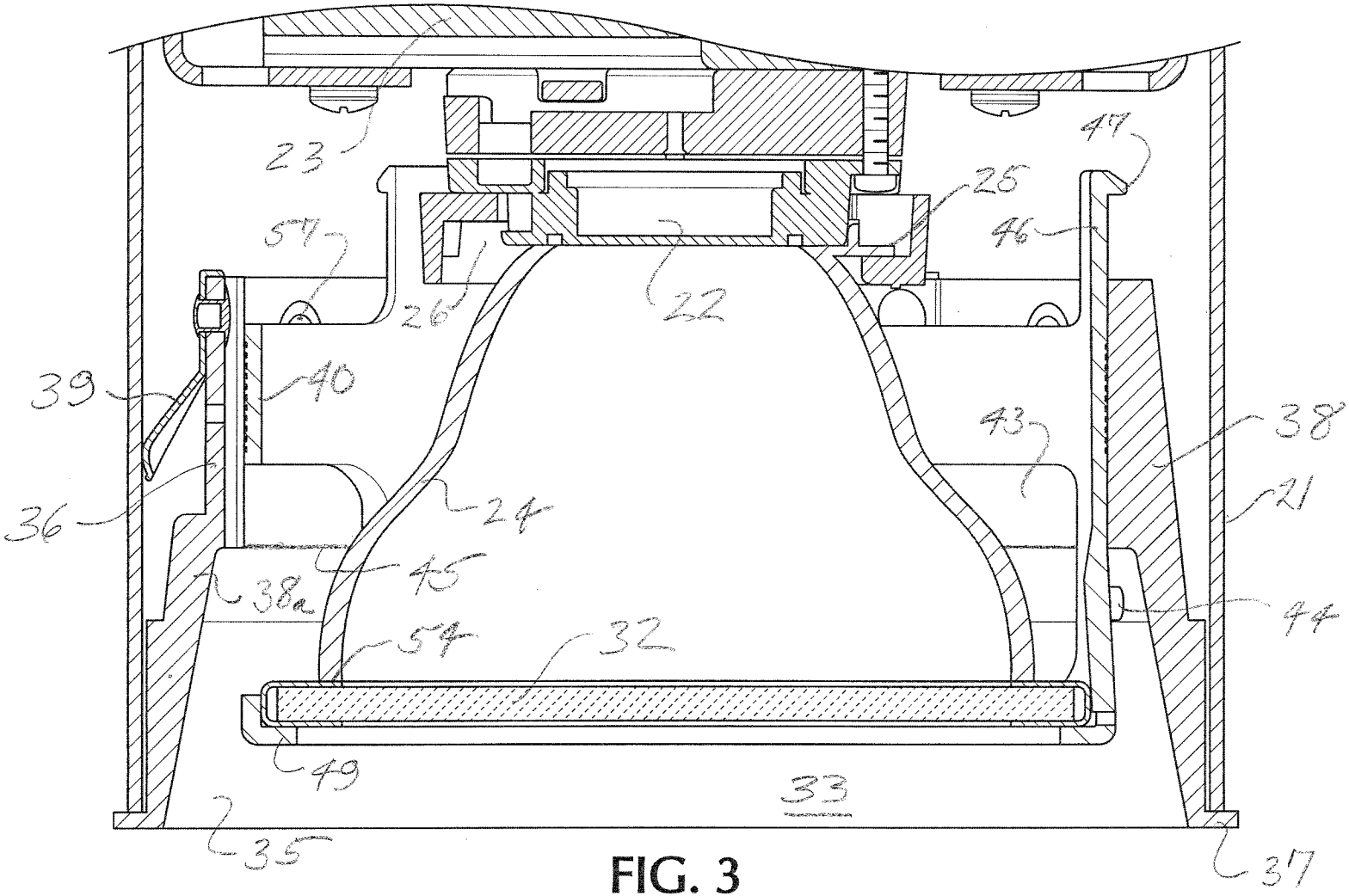
FIG. 3 is a longitudinal cross sectional view of the assembly of FIG. 2.

Referring to the drawings, and initially to FIGS. 1-3 thereof, the reference numeral 20 designates generally a lighting fixture of a type used frequently in commercial and theatrical lighting. The fixture includes a housing 21, a light source module 22 and a power supply 23 for the light source. A suitable, but not limiting, light source module may be an XSM 80 LED module by Xicato, Inc. of San Jose, Calif. Such a module is illustrated in U.S. Pat. No. 7,988,336, the content of which is incorporated herein by reference. A reflector 24 is associated with the light source module and extends axially downward therefrom. In this respect, it will be understood that the lighting fixture 20 may be oriented in any direction, including upward, downward and at any angle to the vertical. Accordingly, directional references herein, and in the claims, to upward, downward and the like are used only for convenience and with respect to the illustrated fixture, which is oriented in a downward direction. Desirably, the reflector 24 is interchangeable in order to provide different degrees of concentration or dispersion of the light beam from the source 22. In the illustrated arrangement, the upper end of the reflector is provided with a plurality of lateral tabs 25 which are received in recesses 26 in the light source module, after which the reflector is rotated about its axis to engage the tabs 25 with locking elements 27 of the light source module 22.

Pursuant to the invention, a novel form of accessory cartridge 30 is provided, which is insertable into the open lower end 31 of the fixture housing 21, for retaining on or more accessory discs 32. In the illustrated example, the cartridge 30 has the capacity to receive up to three accessory discs (or none, if desired). The cartridge 30 is comprised of an outer member 33, which is adapted to be received and retained in the open end of the fixture housing 21, and an inner member 34, which is movably retained within the outer member for a limited extent of telescopic movement.

In the illustrated form of the invention the outer cartridge member 33 includes a lower portion 35 and an upper portion 36. The lower portion 35 is of cylindrical form and is provided with a flange 37 at its lower end. As shown in FIG. 3, the lower portion 35 is adapted to be received closely within the end of the fixture housing 21, with the flange 37 seated against the bottom of the housing to fix the position of the cartridge with respect to the light source module 22. The upper portion 36 of the outer cartridge member is of smaller diameter than the lower portion 35 and spaced somewhat above the lower portion. The upper portion 36 is connected with the lower portion by a plurality of circumferentially spaced apart ribs 38, 38*a*. The arrangement and spacing of the upper and lower portions of the outer member provide, among other things, clearance for the flow of air through the cartridge for cooling of the light source module 22 and its power supply 23.

Suitable means are provided for retaining the outer cartridge member 33 within the fixture housing 21 after installation. In the illustrated embodiment, such means can be in the form of a plurality of retainer springs 39, which are riveted or otherwise secured to the upper portion 36 of the cartridge member 33 and extend outward and downward therefrom as shown in FIGS. 1-3. When the cartridge is inserted into the housing 21, the retainer springs are compressed inwardly to resist downward movement of the cartridge relative to the housing. For intentional cartridge removal, the outer edge margins of the flange 37 extend slightly beyond the outer surface of the housing 21, as shown in FIG. 3, enabling the cartridge to be easily gripped by a hand for removal from the housing.

In the illustrated embodiment of the invention, the inner cartridge member 34 is of generally cylindrical form and has an outer diameter very slightly smaller than the inside diameter of the upper portion 36 of the outer member 33. The arrangement is such that the inner member 34 can be telescopically adjusted axially with respect to the outer member. The inner cartridge member 34 is comprised of upper and lower portions 40, 41 which are connected in fixed relation by circumferentially separated spacer elements 42. In the illustrated arrangement, there are three such spacer elements 42 which are widely separated by openings 43 to accommodate the circulation of air within the fixture.

Each of the spacer elements 42 is provided externally with one or more projections 44, which extend radially outward and are adapted to engage the bottom edge 45 of the upper portion 36 of the outer cartridge member. This serves to define an upper limit of extending telescopic movement of the inner cartridge member 34 relative to the outer member. A lower limit of retracting telescopic movement is provided by means of upward extensions 46, which are preferably although not necessarily aligned with the spacer elements 42. At their upper extremities, the upward extensions are formed with flanges 47 extending radially outward and overhanging the upper edge 48 of the upper portion 36 of the outer cartridge member 33. When the inner cartridge member 34 is moved telescopically downward toward a retracted position, the flanges 47 will engage the upper edge 48 when the retracted limit position is reached. The upward extensions 46 have sufficient flexibility to be displaced radially inward when the inner cartridge member 34 is initially assembled with the outer member 33. In this respect, the upper surfaces of the flanges are angled such that the extensions 46 tend to be cammed inwardly during the initial assembly of the two cartridge members 33, 34.

Figure 10:
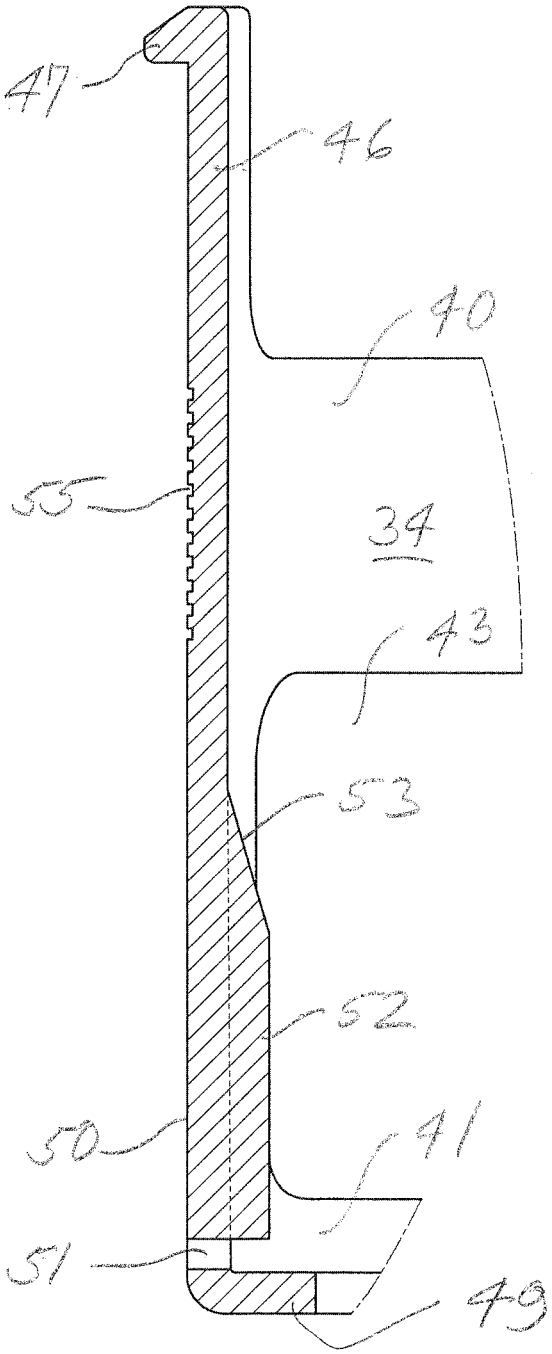
FIG. 10 is an enlarged fragmentary view of a portion of FIG. 8.

The lower portion 41 of the inner cartridge member is formed with an inwardly projecting flange 49 arranged to support outer edge portions of an accessory disc 32 (FIG. 3). The internal diameter of the inner cartridge member 34 is such that it can closely but loosely receive one or more of the accessory discs, stacked one on top of the other. Typically, but not necessarily, the accessory cartridge is designed to receive up to three such accessory discs. Advantageously, the accessory discs 32 are retained in the cartridge member 34 by integral, flexible retaining tongues 50 formed in the spacer elements 42 by means of U-shaped slots 51 therein. The retaining tongues are provided on the inside with axially extending ribs 52, which project inwardly from the cylindrical contours of the spacer elements. The inner surfaces of the ribs 52 lie on a diameter which is slightly smaller than the diameter of the accessory discs 32, and the upper ends 53 of the ribs 52 are tapered into the side walls of the spacers, as illustrated best in FIG. 10, to facilitate downward insertion of the accessory discs into the cartridge member 34.

When an accessory disc is inserted into the inner cartridge member 34, it is initially engaged by the tapered upper end portions 53 of the ribs 52 and must be pushed downwardly with enough pressure to displace the tongues 51 and ribs 52 radially outward, as shown in FIG. 3. The slight outward angle of the displaced ribs 52 imparts a slight downward force component on the disc 32 to retain it is position against the flange 49.

FIG. 3 illustrates the cartridge with a single accessory disc installed. If a second disc (not shown) is inserted on top of the first, the second disc will displace the ribs 52 slightly farther outward, after which the ribs will apply retaining pressure against the upper disc. A similar action results when a third disc (not shown) is inserted on top of the second. In each case, the deflection of the tongues 51 and ribs 52 causes the ribs to press inward and downward on the top most disc to retain the entire stack in the cartridge.

When accessory discs are loaded into the cartridge, the initial loading is followed by telescopically extending the inner cartridge member 34 with respect to the outer cartridge member 33, preferably until the projections 44 engage the edge 45 of the outer cartridge member 33, setting the limit position of the inner member 34 in an extending direction.

Upon a partial insertion of a loaded cartridge into the end of the fixture housing 21, the uppermost accessory disc 32 of a stack (whether a single disc or a stack or two or three) is engaged by the lower end edge 54 of the reflector 24. The accessory discs, and the inner cartridge member 34 are thus stopped and prevented from moving as the outer cartridge member 33 continues to be inserted upwardly into the housing, until the flange 37 engages the end of the housing. After the insertion, the outer cartridge member is held in position in the fixture housing 21 by the retainer springs 39, and the disc stack is held in fixed position against the end of the reflector. Placement of the accessory discs 32 a known, fixed distance from the light source 22 assures optimum efficiencies from the light source and also uniform and optimized output from the accessories.

In the illustration of FIG. 3, with only one accessory disc 32 carried in the inner cartridge member 34, the inner cartridge member is displaced slightly downward relative to the outer member 33, as is indicated by the position of the projections 44 in FIG. 3. If three accessory discs are loaded into the inner member it would be displaced further downward, by the thickness of the two additional discs, such that the lowermost disc of the stack will be located at a level adjacent to the level of the bottom edge of the outer cartridge member 33. In cases were no accessory discs are loaded, the inner cartridge member would remain in its fully extended position after installation of the cartridge into the fixture housing 21, with the projections 44 against the edge 45, in which position the flange 49 is entirely out of the path of light emanating from the reflector 24. In all cases in which at least one disc is present, the uppermost disc will be held in contact with the end of the reflector 24.

Figure 5:
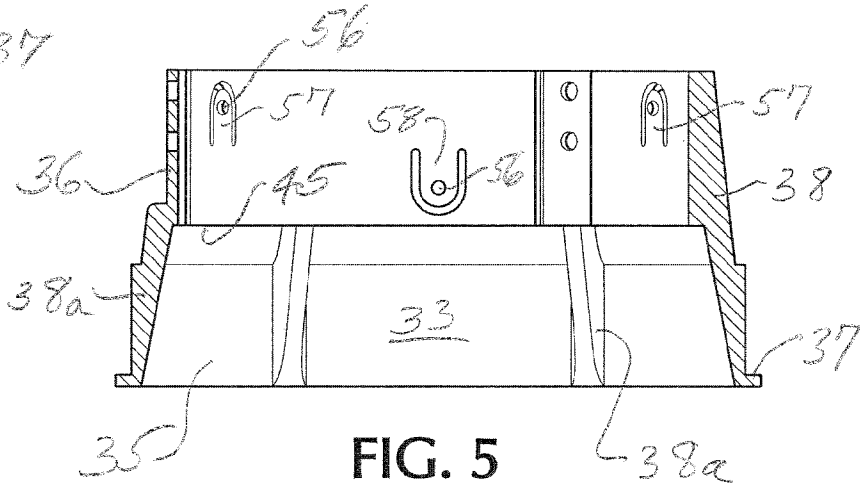
FIG. 5 is a cross sectional view as taken along line 5-5 of FIG. 4.
Figure 4:
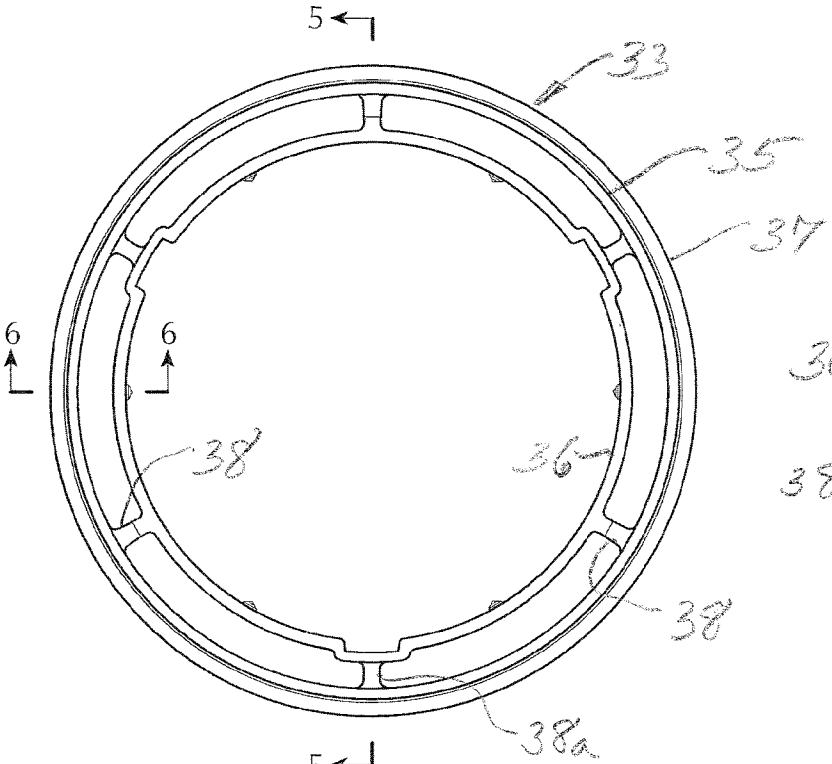
FIG. 4 is a top view of the accessory cartridge of the invention.
Figure 6:
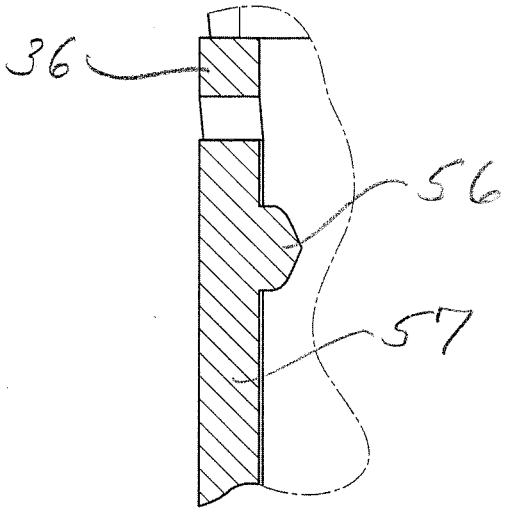
FIG. 6 is an enlarged, fragmentary cross sectional view as taken along line 6-6 of FIG. 4.
Figure 7:
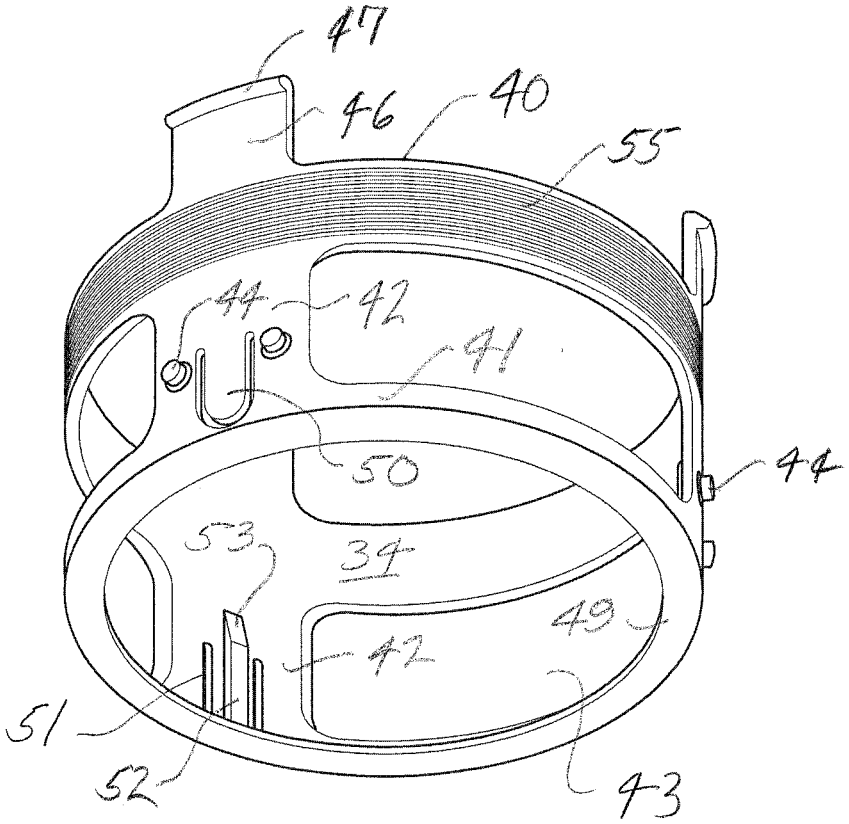
FIG. 7 is a perspective view from below of an inner member of the accessory cartridge of the invention.
Figure 8:
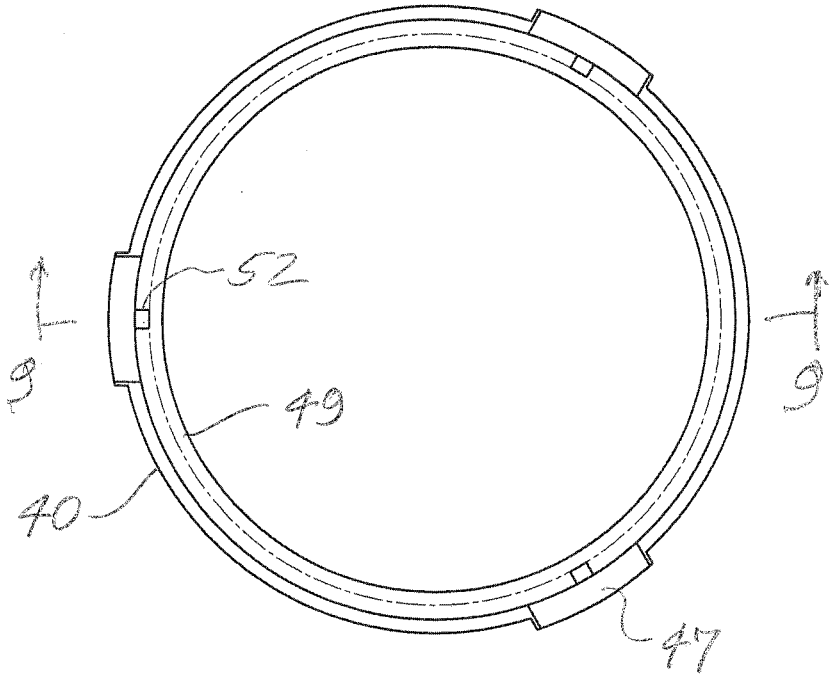
FIG. 8 is a top view of the cartridge member of FIG. 7.
Figure 9:
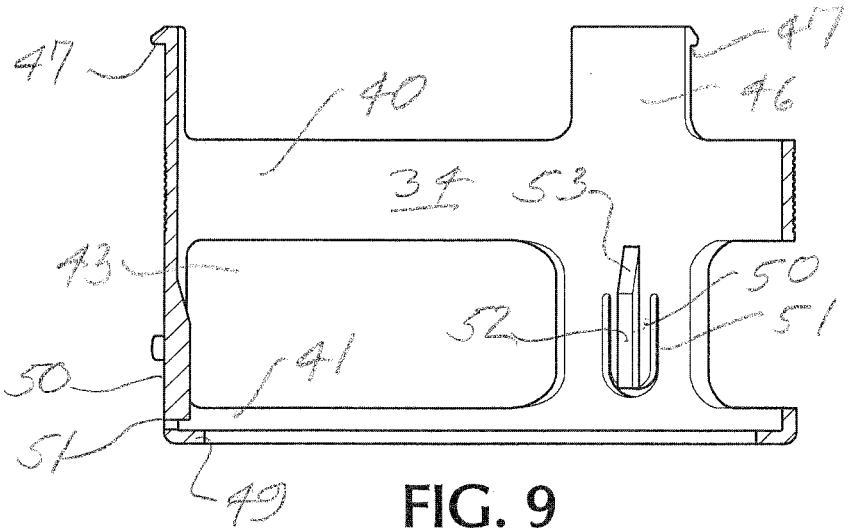
FIG. 9 is a cross sectional view as taken along line 9-9 of FIG. 8.

In order to hold the inner cartridge member 34 in whatever position it assumes after insertion of the outer cartridge member 33 into the fixture housing, a detent arrangement is provided which will retain the inner member in position with respect to the outer member, unless intentionally changed. To this end, the outer surface of upper portion 40 on the inner cartridge member is formed with a plurality of circumferential detent grooves 55 engageable by detent projections 56 extending inwardly from upper and/or lower sets of flexible tongues 57, 58 formed in the wall of the upper portion 36 of the outer cartridge member 33 (FIGS. 5, 6). When the inner member 34 is in or near a fully extended position, the projections 56 of the upper tongues 57 will grip the grooves 55, while the projections 56 of the lower tongues will grip the grooves when the inner cartridge is in a lower or more retracted telescopic position. Accordingly, upon installation of the cartridge in the end of the housing 21, and resulting displacement of the inner cartridge member by contact between an upper accessory disc and the reflector 24, the inner cartridge member will be retained in its displaced position, with the uppermost disc against the bottom edge 54 of the reflector.

The new articulating accessory cartridge of the invention makes it easy and reliable to position the accessory discs, regardless of number thereof, in an optimum relation to the light source, such that optimum and reproducible lighting effects may be achieved. Changing of accessory discs in the cartridge is a simple matter of pushing them upwardly out of the inner cartridge member 34, for removal, and downwardly for loading. The uppermost disc is engaged by the retaining tongues 50 to retain all of the installed accessory discs in a tight stack against the lower flange 49, and installation of the loaded cartridge into a fixture housing automatically telescopically repositions the inner cartridge 34 member as necessary to locate the accessories mounted therein in optimal relation to the light source.

It should be understood, or course that the particular embodiments of the invention herein illustrated and described are intended to be representative of the invention but not limiting thereof. Accordingly, reference should be made to the following appended claims in determining the full scope of the invention.

What is claimed is:

1. An accessory cartridge for a lighting fixture of the type comprising a light source and a cylindrical housing surrounding said light source and having an open end and having a cartridge-engaging stop element spaced from said open end, the accessory cartridge comprising a first member removably mountable on the open end of said housing, a second member telescopically engaged with said first member and movable between axially extended and axially retracted limit positions with respect to said first member, said second member being of a size and shape to receive one or more accessory elements for said lighting fixture, said first and second members being so dimensioned and arranged that, when said first member is mounted on the open end of said housing while said second member is positioned in said axially extended limit position, an uppermost one of said accessory elements will engage said stop element and, if necessary, cause said second member to be displaced in a retracting direction to accommodate said mounting while positioning and retaining said uppermost one of said accessory elements in a fixed predetermined relation with said light source, said lighting fixture includes a reflector surrounding said light source and extending axially therefrom toward the open end of said housing, said reflector having an open end spaced axially inward from the open end of said housing, and the open end of said reflector forms said stop element.

2. An accessory cartridge according to claim 1, wherein said first member is mountable in a fixed position on said housing with at least portions of said first member being positioned internally of said housing, and said second member is telescopically received within said first member.

3. An accessory cartridge according to claim 2, wherein said first member has a first portion received in lower portions of said housing open end and a second portion, spaced radially inwardly from said first portion and slidably engaging said second member, and at least one of said first or second members has motion limiting projections engageable with the other of said members to limit telescopic movement of said second member relative to said first member to positions between said limit positions.

4. An accessory cartridge according to claim 3, wherein one of said first or second members has resiliently displaceable projections thereon engaging surface areas of the other of said members, and said surface areas are formed with groves engageable with said displaceable projections.

5. An accessory cartridge according to claim 2, wherein said first member has a first portion received in lower portions of said housing open end and a second portion spaced radially inward from and axially above said first portion and joined therewith by a plurality of circumferentially spaced, axially extending connecting elements.

6. An accessory cartridge according to claim 5, wherein said second member comprises a lower portion at a lower end thereof having a shape and size to receive one or more accessory elements and an upper portion spaced above said lower portion, and said upper and lower portions of said second member are joined by circumferentially spaced connecting walls defining between them and between said upper and lower portions, open spaces for the flow of air.

7. An accessory cartridge according to claim 6, wherein said connecting walls are formed with U-shaped slots therein defining downwardly projecting tongues, said tongues have portions projecting inwardly with respect to adjacent surfaces of said connecting walls, and said inwardly projecting portions of said tongues are engageable with and outwardly displaceable by accessory elements inserted axially downward into said second member.

8. An accessory cartridge according to claim 7, wherein said accessory elements are of a generally flat, disc-like form, said tongues are of a length corresponding to the combined thicknesses of two or more accessory elements, and said tongues, when displaced outwardly by accessory elements, engage at least an uppermost one of said accessory elements.

9. An accessory cartridge according to claim 8, wherein said connecting walls are configured to loosely confine said accessory elements, and said inwardly projecting portions of said tongues are outwardly displaced by said accessory elements such that said tongues engage and retain said accessory elements in said second member.

10. An accessory cartridge according to claim 5, wherein resilient retaining elements extend radially outward from one of said first or second portions of said first member for engagement with inner walls of said housing.

11. An accessory cartridge according to claim 6, wherein the upper portion of said second member is formed with one or more upward extensions which, when said second member is in an axially extended position, project above the second portion of said first member, said upward extensions are formed with radially outward projections engagable with the second portion of said first member to form a limit stop to axial extending movements of said second member.

12. An accessory cartridge according to claim 11, wherein the connecting walls of said second member are formed with radially outward projections engageable with said first member to form a limit stop to axially retracting movements of said second member.

13. An accessory cartridge for holding disc-like lighting fixture accessories of circular form, which comprises, a first member comprising a cylindrical lower portion of a first diameter and first height, a cylindrical upper portion of a second diameter which is smaller than said first diameter, and a plurality of circumferentially spaced and axially disposed connecting elements joining said upper and lower portions, a second member comprising vertically spaced apart and cylindrically configured upper and lower portions joined by circumferentially spaced apart connecting walls, said second member being received within the upper portion of said first member for axial telescoping movement of said second member relative to the first member, one of said first or second members having a plurality of integral tongue elements formed therein at circumferentially spaced locations, said tongue elements having detent projections thereon extending toward the other of said first or second members and engageable with said other member to resist relative axial telescoping movement between said first and second members, at least one of said first or second members have projecting stop elements engageable with the other of said first or second members to limit axial telescoping movement in extending and retracting directions, said second member having a plurality of resilient elements in the lower portion for engaging and retaining one or more disc-like accessories.

14. An accessory cartridge according to claim 13, wherein the surface of said other of said members engaged by said tongue element projections is formed with a plurality of circumferential detent grooves for receiving said detent projections.

15. An accessory cartridge according to claim 13, wherein said second member has an extended telescopic position, relative to said first member, in which a disc-like accessory is spaced above a bottom edge of said first member, and an extended telescopic position in which a disc-like accessory is at a level adjacent the level of said bottom edge.

16. An accessory cartridge according to claim 13, wherein said plurality of resilient elements comprise downwardly extending tongue-like elements formed in said connecting walls, said tongue-like elements having vertically extending portions thereof what project radially inward of said connecting walls, whereby said tongue-like elements are deflected radially outward when a disc-like accessory is positioned in the lower portion of said second member and whereby said tongue-like elements engage an uppermost one of a plurality of disc-like accessories positioned in a stack in said lower portion.

* * * * *